US010156113B2

(12) United States Patent
Gustafson

(10) Patent No.: US 10,156,113 B2
(45) Date of Patent: Dec. 18, 2018

(54) BOP CONTROL SYSTEM CIRCUIT TO REDUCE HYDRAULIC FLOW/WATER HAMMER

(71) Applicant: Hydril USA Distribution, LLC, Houston, TX (US)

(72) Inventor: Ryan Cheaney Gustafson, Houston, TX (US)

(73) Assignee: HYDRIL USA DISTRIBUTION LLC, Houston, TX (US)

( * ) Notice: Subject to any disclaimer, the term of this patent is extended or adjusted under 35 U.S.C. 154(b) by 302 days.

(21) Appl. No.: 15/010,608

(22) Filed: Jan. 29, 2016

(65) Prior Publication Data

US 2016/0222746 A1 Aug. 4, 2016

Related U.S. Application Data

(60) Provisional application No. 62/110,242, filed on Jan. 30, 2015.

(51) Int. Cl.
*E21B 33/035* (2006.01)
*E21B 33/06* (2006.01)
(Continued)

(52) U.S. Cl.
CPC ..... *E21B 33/0355* (2013.01); *E21B 33/06* (2013.01); *E21B 33/062* (2013.01); *E21B 33/064* (2013.01); *E21B 34/16* (2013.01)

(58) Field of Classification Search
CPC .... E21B 33/0355; E21B 33/06; E21B 33/062; E21B 33/064
(Continued)

(56) References Cited

U.S. PATENT DOCUMENTS 4,305,428 A 12/1981 Burton
4,662,831 A 5/1987 Bennett
(Continued)

FOREIGN PATENT DOCUMENTS

WO 2013192494 A1 12/2013
WO 2015053963 A1 4/2015
(Continued)

OTHER PUBLICATIONS

Wang et al., "Water Hammer Effects on Water Injection Well Performance and Longevity", SPE International Symposium and Exhibition on Formation Damage Control, pp. 1-9, Lafayette, Louisiana, USA, Feb. 13-15, 2008.
(Continued)

*Primary Examiner* — Thomas E Lazo
*Assistant Examiner* — Daniel Collins
(74) *Attorney, Agent, or Firm* — Hogan Lovells US LLP

(57) ABSTRACT

A subsea blowout preventer (BOP) hydraulic control system to reduce water hammer that includes a hydraulic fluid source. The system further includes a fluid supply conduit in fluid communication with the hydraulic fluid source at an upstream end, and with a BOP function at a downstream end. The system further includes a supply valve in the fluid supply conduit that controls the amount of fluid flow through the fluid supply conduit to the BOP function, the supply valve having an open state and a closed state. The supply valve has a choke that controls movement of the supply valve between the open state and the closed state and vice versa so that such movement is retarded when the supply valve state approaches the fully open or the fully closed state to reduce pressure spikes in the fluid of the fluid supply conduit.

20 Claims, 5 Drawing Sheets

(51) Int. Cl.
*E21B 34/16* (2006.01)
*E21B 33/064* (2006.01)

(58) Field of Classification Search
USPC ..... 60/421
See application file for complete search history.

(56) References Cited

U.S. PATENT DOCUMENTS

| | | | | |
|---|---|---|---|---|
| 5,186,393 | A | 2/1993 | Yie | |
| 6,276,458 | B1 | 8/2001 | Malone et al. | |
| 6,505,691 | B2 | 1/2003 | Judge | |
| 6,904,982 | B2 | 6/2005 | Judge | |
| 8,469,048 | B2 | 6/2013 | Bresnahan | |
| 8,939,215 | B2 | 1/2015 | McMiles | |
| 9,038,728 | B1 * | 5/2015 | Lugo | E21B 33/064 166/338 |
| 9,163,388 | B2 | 10/2015 | Cheney et al. | |
| 2002/0100501 | A1 | 8/2002 | Hollister et al. | |
| 2011/0098946 | A1 | 4/2011 | Curtiss | |
| 2012/0103629 | A1 * | 5/2012 | Dietz | E21B 33/063 166/376 |
| 2012/0111572 | A1 | 5/2012 | Cargol | |
| 2012/0312546 | A1 | 12/2012 | Bussear et al. | |
| 2015/0129233 | A1 | 5/2015 | Gaude et al. | |

FOREIGN PATENT DOCUMENTS

| | | | |
|---|---|---|---|
| WO | 2015073452 | A1 | 5/2015 |
| WO | 2015153818 | A2 | 10/2015 |

OTHER PUBLICATIONS

Tang et al., "A Dynamic Simulation Study of Water Hammer for Offshore Injection Wells to Provide Operation Guidelines", SPE Production & Operations, vol. 25, Issue:04, pp. 509-523, Nov. 2010.

PCT Search Report and Written Opinion issued in connection with corresponding PCT Application No. PCT/US16/15659 dated May 11, 2016.

* cited by examiner

BOP CONTROL SYSTEM CIRCUIT TO REDUCE HYDRAULIC FLOW/WATER HAMMER

CROSS-REFERENCE TO RELATED APPLICATIONS

This application claims priority to U.S. Provisional Patent Appln. No. 62/110,242, which was filed on Jan. 30, 2015, the full disclosure of which is hereby incorporated herein by reference in its entirety.

BACKGROUND OF THE INVENTION

1. Technical Field

Embodiments of the subject matter disclosed herein generally relate to subsea oil and gas drilling equipment. More particularly, the present technology relates to accumulator valves for use in subsea oil and gas drilling hydraulic circuits.

2. Discussion of the Background

Blowout preventers (BOPS) are important safety components in subsea well drilling operations. Typically, a BOP is attached to a wellhead at the sea floor, and provides a bore through which the drill string can pass from the top of the BOP down through the bottom and into the well. The BOP is equipped with BOP rams, which are located on opposing sides of the bore and are designed to close across the bore if needed. Some rams are sealing rams, which seal around the drill pipe to close in the annulus of the well. Other rams are shearing rams, and are designed to shear the drill pipe and anything else in the bore, to completely close in the bore. The BOP and its rams provide an effective barrier against dangerous pressure surges that may develop in a well.

In order to operate the BOP rams, hydraulics are typically used to drive the rams from an open to a closed position. Hydraulic fluid is applied to the rams via a fluid conduit that connects the rams to a fluid reservoir or accumulator. A valve or series of valves in the fluid conduit controls the fluid flow through the conduit, which in turn determines the hydraulic pressure applied to the rams. The forces needed to drive the BOP rams can be large, as the equipment is heavy, and much force may be required to shear the steel drill string and other components in the bore. Accordingly, if it becomes necessary for an operator to fire the rams and close the BOP, a significant amount of hydraulic pressure is applied to close the rams.

Because the hydraulic pressure needed to close the rams is high, the corresponding rate of hydraulic fluid flow through the conduit is also high. Accordingly, when the supply valve opens to allow fluid flow to drive the rams, the change in velocity of fluid at the rams can be large and sudden. Similarly, when the supply valve closes at the end of the function, the fluid flow is suddenly stopped. These sudden changes in velocity lead to pressure spikes in the fluid at the opening and closing of the supply valve, which pressure spikes are typically referred to in the industry as hydraulic shock, or water hammer. Water hammer can cause significant damage to components on the BOP.

In addition, after maintenance or during initial start-up of BOP equipment, hydraulic lines can require air to be purged from the system. This is typically done by cycling the equipment to fill the lines. During air purging, water hammer can be induced by the rapid hydraulic velocities involved with such a fill and purge.

SUMMARY OF THE INVENTION

One embodiment of the present technology provides a subsea blowout preventer (BOP) hydraulic control system to reduce water hammer. The system includes a first hydraulic fluid source, a first fluid supply conduit in fluid communication with the first hydraulic fluid source at an upstream end, and with a BOP function at a downstream end, and a first supply valve in the first fluid supply conduit that controls the amount of fluid flow through the first fluid supply conduit to the BOP function, the first supply valve having an open state and a closed state. The first supply valve includes a first choke that controls movement of the first supply valve between the open state and the closed state and vice versa so that such movement is retarded when the first supply valve state approaches the fully open or the fully closed state to reduce pressure spikes in the fluid of the first fluid supply conduit.

Another embodiment of the present technology provides a subsea BOP hydraulic control system to reduce water hammer. The system includes an accumulator, a fluid supply conduit in fluid communication with the accumulator at an upstream end, and with a BOP function at a downstream end, and a supply valve in the fluid supply conduit that controls the amount of fluid flow through the fluid supply conduit to the BOP function, the supply valve having an open state and a closed state. The supply valve is shaped to reduce the fluid flow rate in the fluid supply conduit downstream of the supply valve relative to the fluid flow rate in the fluid supply conduit upstream of the supply valve in order to reduce hydraulic shock.

In yet another embodiment of the present technology, there is provided a method of firing a BOP function. The method includes the steps of driving the BOP function using hydraulic fluid from a hydraulic fluid source, the hydraulic fluid delivered to the function via a fluid supply conduit between the hydraulic fluid source and the BOP function, and regulating the flow rate of the hydraulic fluid in the fluid supply conduit with a supply valve positioned in the fluid supply conduit between the hydraulic fluid source and the BOP function, the supply valve having a closed position, where fluid flow through the supply valve is restricted, and an open position, where some fluid passes through the supply valve. The method also includes the steps of, to initiate the BOP function, gradually opening the supply valve to gradually increase the rate of fluid flow through the supply valve up to a predetermined amount, and, before termination of the BOP function, gradually closing the supply valve to gradually decrease the rate of fluid flow through the supply valve until the BOP function is complete.

BRIEF DESCRIPTION OF THE DRAWINGS

The present technology can be better understood on reading the following detailed description of nonlimiting embodiments thereof, and on examining the accompanying drawings, in which.

DETAILED DESCRIPTION OF THE PREFERRED EMBODIMENT

Figure 1:
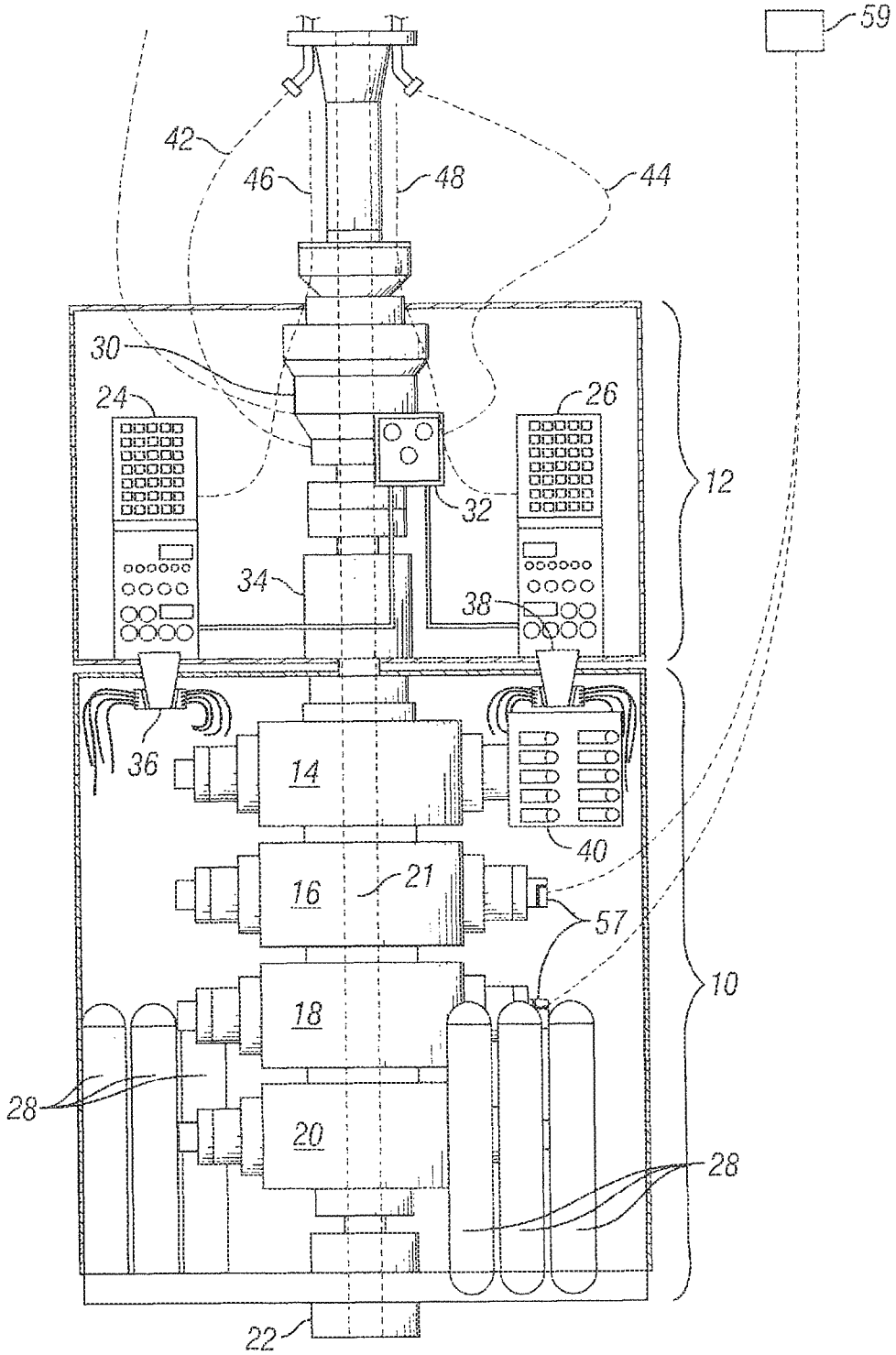
FIG. 1 is a side view of a subsea BOP assembly according to an embodiment of the present technology.

The foregoing aspects, features, and advantages of the present technology can be further appreciated when considered with reference to the following description of preferred embodiments and accompanying drawings, wherein like reference numerals represent like elements. The following is directed to various exemplary embodiments of the disclosure. The embodiments disclosed should not be interpreted, or otherwise used, as limiting the scope of the disclosure, including the claims. In addition, those having ordinary skill in the art can appreciate that the following description has broad application, and the discussion of any embodiment is meant only to be exemplary of that embodiment, and not intended to suggest that the scope of the disclosure, including the claims, is limited to that embodiment.

FIG. 1 shows a subsea blow out preventer (BOP) assembly, including a lower stack 10 and a lower marine riser package (LMRP) 12. Typically, the lower stack includes a series of stacked rams 14, 16, 18, 20. The lower stack 10 of FIG. 1, for example, can include a blind shear ram 14, a casing shear ram 16, and pipe rams 18, 20. In practice, the rams 14, 16, 18, 20 surround a bore 21 through which a drill pipe (not shown) passes. The lower stack 10 is positioned atop the wellhead 22, so that the drill pipe passes from the bottom of the lower stack 10 into the well through the wellhead 22. The purpose of the rams is to control the well if needed. For example, if a surge of pressure develops in the well annulus, the pipe rams 18, 20 can close and seal around the pipe to contain the pressure in the annulus below the pipe rams 18, 20. In some cases it may be necessary or desirable for an operator to completely close in a well, in which case the blind shear ram 14 and/or the casing shear ram 16 can close to sever everything in the bore 21, including the drill pipe.

Typically, the rams 14, 16, 18, 20 are hydraulically controlled. Hydraulic pressure can be supplied via the control pods 24, 26, which can be positioned in the LMRP 12. The provision of two control pods 24, 26, often referred to in the industry as a blue pod 24 and a yellow pod 26, allows for redundancy in the control system, and also increased control capacity. In addition to the control pods 24, 26, there can be provided accumulator tanks 28. The accumulator tanks 28 can be filled with gas at high pressure relative to the ambient pressure of the sea water, and when discharged can exert a strong hydraulic force on the rams 14, 16, 18, 20, causing them to close. The accumulator tanks 28 ore often provided as a backup option to the control pods 24, 26, as they must be recharged after each use, and so are not as convenient as the pods 24, 26 for purposes of closing the rams 14, 16, 18, 20.

Additional features of the BOP assembly of FIG. 1 include the annular BOP 30, a conduit manifold 32, an LMRP connector 34, hydraulic wedges 36, 38, and shuttle panel 40. The BOP assembly further includes communication umbilicals 42, 44 and power umbilicals 46, 48 that provide communication and power capabilities, respectively to the control pods 24, 26.

Figure 2:
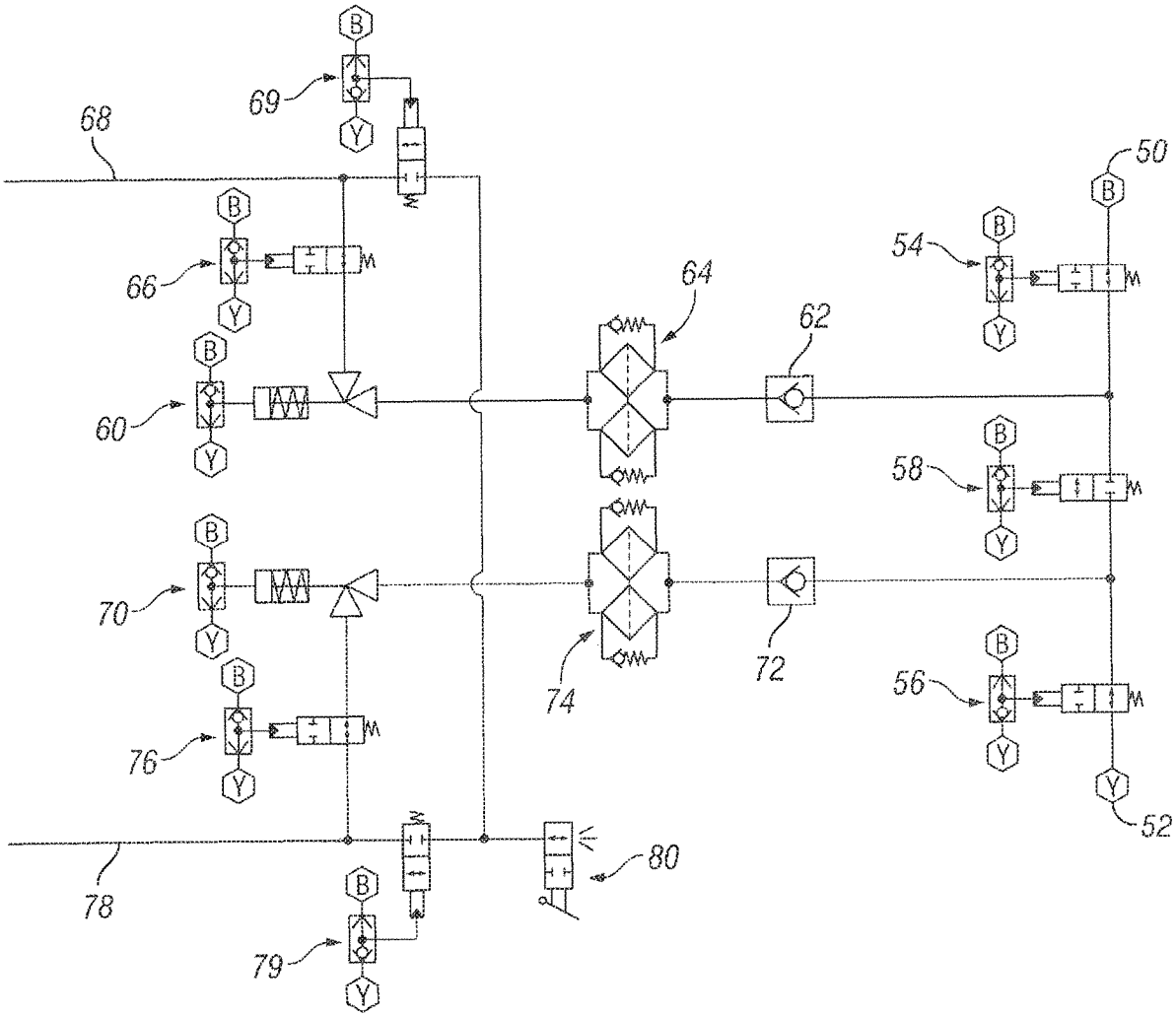
FIG. 2 is a hydraulic circuit diagram showing a BOP stack fluid conduit hydraulic supply, according to an embodiment of the present technology.

Referring now to FIG. 2, there is shown a hydraulic circuit of an embodiment of the present technology. Specifically, there is shown a blue pod hydraulic supply 50 and a yellow pod hydraulic supply 52. The blue pod hydraulic supply 50 is fluidly connected to a blue pod isolation valve 54, while the yellow pod hydraulic supply 52 is fluidly connected to a yellow pod isolation valve 56. A rigid conduit cross-over valve 58 can be provided between the blue pod isolation valve 54 and the yellow pod isolation valve 56. In many BOP operations, both blue and yellow pod isolation valves 54, 56 are in the open state, so that hydraulic functions downstream are controlled by only one of the pods 24, 26 which have internal isolation valves (not shown). The blue or yellow pod isolation valves 54, 56 are typically only closed in the event that one pod or the other has an uncontrolled leak.

With respect to the portion of the hydraulic circuit corresponding to the blue pod 24, when the blue pod isolation valve 54 is in the open state, the blue pod supply 50 is in fluid communication with a first supply valve 60. In some embodiments, such as that shown in FIG. 2, a blue conduit check valve 62 and/or a blue conduit filter assembly 64 can be positioned between the blue pod isolation valve 54 and the first supply valve 60. The blue conduit check valve 62 can serve to prevent backflow of fluid toward the blue conduit filter assembly 64, blue flow control choke valve 60, and blue rigid conduit isolation valve 66. The blue rigid conduit filter assembly 64 serves to filter contaminates and debris from hydraulic fluid in the conduits.

Once fluid passes through the blue rigid conduit 68 it can optionally pass through the blue rigid conduit isolation valve 66 downstream through the first supply valve 60 through the rigid conduit filters 64, check valve 62, and to the pod isolation valve 54. Thereafter, the fluid can pass through the blue pod supply 50. Alternately, the fluid can pass through the blue rigid conduit dump valve 69, through to the blue manual rigid conduit dump valve 80, and on to the environment. Blue pod isolation valve 54 communicates with downstream functions, such as, for example, the BOP rams 14, 16, 18, 20. Adjustment of hydraulic pressure in the blue supply line 68 can open or close the rams 14, 16, 18, 20, collectively or individually as desired by a drilling operator. Also shown in the embodiment of FIG. 2 is a blue dump valve 69 which can serve to bleed pressure from the blue supply line 68 typically during flushing operations to clean the lines prior to operations. In practice, the blue dump valve 69 can be opened to allow venting of fluid into the environment or back to a reservoir at the surface or elsewhere. The blue dump valve 69 can thus act as a safeguard against over pressurization of the blue supply line 68. The blue dump valve 69 can typically be a fail closed valve.

Similarly with respect to the portion of the hydraulic circuit corresponding to the yellow pod 26, when the yellow pod isolation valve 56 is in the open state, the yellow pod supply 52 is in fluid communication with a second supply valve 70. In some embodiments, such as that shown in FIG. 2, a yellow conduit check valve 72 and/or a yellow conduit filter assembly 74 can be positioned between the yellow pod isolation valve 56 and the second supply valve 70. The yellow conduit check valve 72 can serve to prevent backflow of fluid toward yellow filter housing 74, yellow flow control choke valve 70, and yellow rigid conduit isolation valve 76. The yellow rigid conduit filter assembly 74 can serve to filter contaminates and debris from hydraulic fluid in the conduits.

Once fluid passes through the yellow rigid conduit 78 it can optionally pass through the yellow rigid conduit isolation valve 76 downstream through the first supply valve 70 through the rigid conduit filters 74, check valve 72, and to the pod isolation valve 56. Thereafter, the fluid can pass through the yellow pod supply 52. Alternately, the fluid can pass through to the yellow manual rigid conduit dump valve 80, and on to the environment. Yellow pod isolation valve 56 communicates with downstream functions, such as, for example, the BOP rams 14, 16, 18, 20. Adjustment of hydraulic pressure in the yellow supply line 78 can open or close the rams 14, 16, 18, 20, collectively or individually as desired by a drilling operator. Also shown in the embodiment of FIG. 2 is a yellow dump valve 79 which can serve to bleed pressure from the yellow supply line 78 typically during flushing operations to clean the lines prior to operations. In practice, the yellow dump valve 79 can be opened to allow venting of fluid into the environment or back to a reservoir at the surface or elsewhere. The yellow dump valve 79 can thus act as a safeguard against over pressurization of the yellow supply line 78. The yellow dump valve 79 can typically be a fail closed valve. The system can also include a remotely operated vehicle (ROV) flush valve 80 in fluid communication with both the blue and yellow dump valves 69, 79 to flush the conduits is desired.

One problem with some known BOP systems is hydraulic shock, or water hammer. Water hammer occurs when a fluid is forced to suddenly change velocity or direction. For example, in the BOP system of FIG. 2, a function can be fired by opening the first or second supply valve 60, 70, thereby allowing fluid from rigid conduit supply 68 or 78 to flow through the first or second supply valve 60, 70 into the blue or yellow pod supply 50, 52. The sudden increase in velocity of the flow through the supply line can cause a pressure surge that can damage equipment. Similarly, when the function reaches the end of its stroke, the fluid in the supply line suddenly stops flowing, and the resulting momentum change can lead to a pressure surge at the end of the stroke as well. One advantage to the present technology is that it provides a way to reduce or eliminate water hammer in the BOP system.

For example, according to the embodiment of the technology shown in FIG. 2, the first and second supply valves 60, 70 can be variable choke valves, capable of moving between an open and a closed state, and vice versa, in a controlled manner. In practice, when a function is fired, the first and second supply valves 60, 70 can transition from a closed state to an open state gradually, over a determined period of time. Such a gradual opening of the valve causes a corresponding gradual increase in the flow through the valve to reduce or eliminate the pressure surge and associated water hammer that can occur at the beginning of the stroke. Later, as the function nears completion, the first and second supply valve can gradually move from the open position to the closed position, again over a determined period of time. Such a controlled closing of the valve leads to a corresponding controlled reduction of flow and reduction or elimination of the pressure surge and water hammer at the end of the stroke. As shown in FIG. 2, the supply valves 60, 70 can be fail open valves, meaning that the valves are biased toward the open position, so that they will remain open in the event of a valve control failure.

Figure 3:
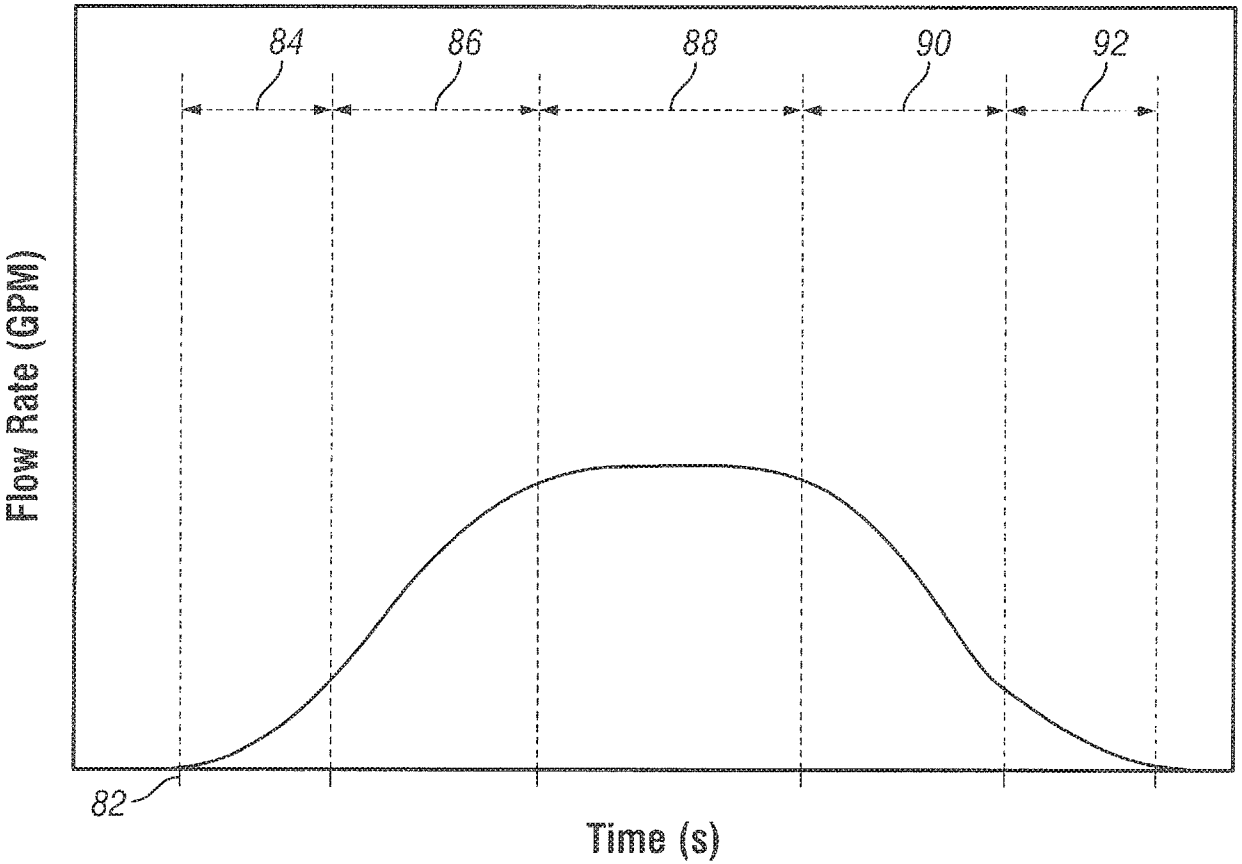
FIG. 3 is a chart showing the flow rate vs. time of fluid through a supply valve according to an embodiment of the present technology.

FIG. 3 provides a graphical depiction of the flow rate through the supply valve 60, 70 as a function is fired in a state where pressure is present in the valves and downstream conduit. Specifically, the function is fired at point 82 on the graph, and starting at firing the flow rate can optionally remain low for a set period of time 84. Thereafter, during the period of time represented by numeral 86, the supply valve 60, 70 is gradually opened to allow greater flow through the supply valve 60, 70 after the function is initially operated. During period of time 88, full flow is permitted through the supply valve 60, 70. As the function begins to near completion, the supply valve 60, 70 begins to gradually close during period of time 90. As the supply valve 60,70 gradually closes, the flow rate through the valve gradually decreases. During period of time 92, at the end of the stroke, the flow rate is again low. The smooth rise and fall of the flow rate depicted by the graph of FIG. 3 is a representation of the lack of pressure surges that would cause water hammer in the BOP system of the present technology.

In practice, the specific timing of the opening and closing of the supply valves 60, 70, including the transition periods between open and close at either end of a stroke, can be adjusted according to the specific function. In some embodiments, sensors 57 can be positioned on the equipment associated with a function to determine where the function is during the course of its stroke. If the function is the closing of BOP rams, for example, a sensor 57 may be installed on the ram piston to determine the position of the ram piston throughout the stroke. The sensor 57 can communicate with a controller 59 on a drilling vessel, or on the BOP stack assembly to indicate when the function is starting and when the piston is nearing the end of its stroke. Using this information, the controller 59 can instruct the supply valve 60, 70 (via the choke) to begin opening or closing, to move between open and closed positions at varying speeds, etc. to achieve a desired flow rate throughout the length of the stroke of the piston. The ideal flow curve for each function can be automatically determine using software in a processor attached to the controller, or can be determined by a drilling operator in real time or otherwise.

Figure 4A:
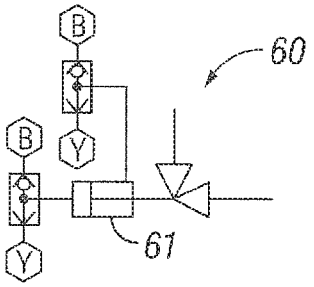
FIG. 4A shows a supply valve of an embodiment the present technology with an open/close control choke.

FIGS. 4A-4D depict different embodiments of the supply valve 60, 70 according to the present technology. For the sake of clarity, in FIGS. 4A-4D, the supply valve is identified only using the reference number 60, corresponding to the first supply valve. It is to be understood, however, that the following description with regard to first supply valve 60 applies equally to second supply valve 70. In FIG. 4A, there is depicted a supply valve 60 controlled by an open/close flow control choke 61. In this embodiment, the position of the valve corresponds to the position of the hydraulic choke, which can be controlled by an operator or automated controlled, and which is not biased toward the open or the closed position.

Figure 4B:
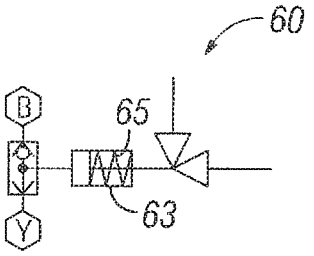
FIG. 4B shows a supply valve of an embodiment the present technology with a fail open flow control choke.
Figure 4C:
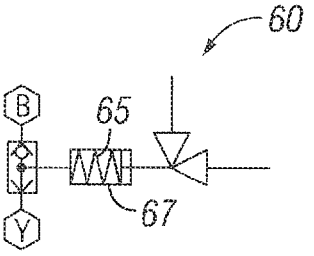
FIG. 4C shows a supply valve of an embodiment the present technology with a fail closed flow control choke.
Figure 4D:
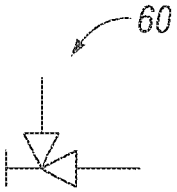
FIG. 4D shows a supply valve of an embodiment the present technology with a manual flow control choke.

In FIG. 4B, there is depicted a supply valve 60 controlled by a fail open flow control choke 63. This is the embodiment shown in FIG. 2. The fail open flow control choke includes a spring 65 or other biasing mechanism that pushes the choke toward the open position in the absence of sufficient opposing hydraulic force closing the choke. Conversely, in FIG. 4C there is depicted a supply valve 60 controlled by a fail close flow control choke 67. The fail close flow control choke includes a spring 65 or other biasing mechanism that pushes the choke toward the closed position in the absence of sufficient opposing hydraulic force opening the choke. FIG. 4D depicts a manual flow control choke, wherein the position of the choke is manually controlled, without the use of hydraulics.

Figure 5:
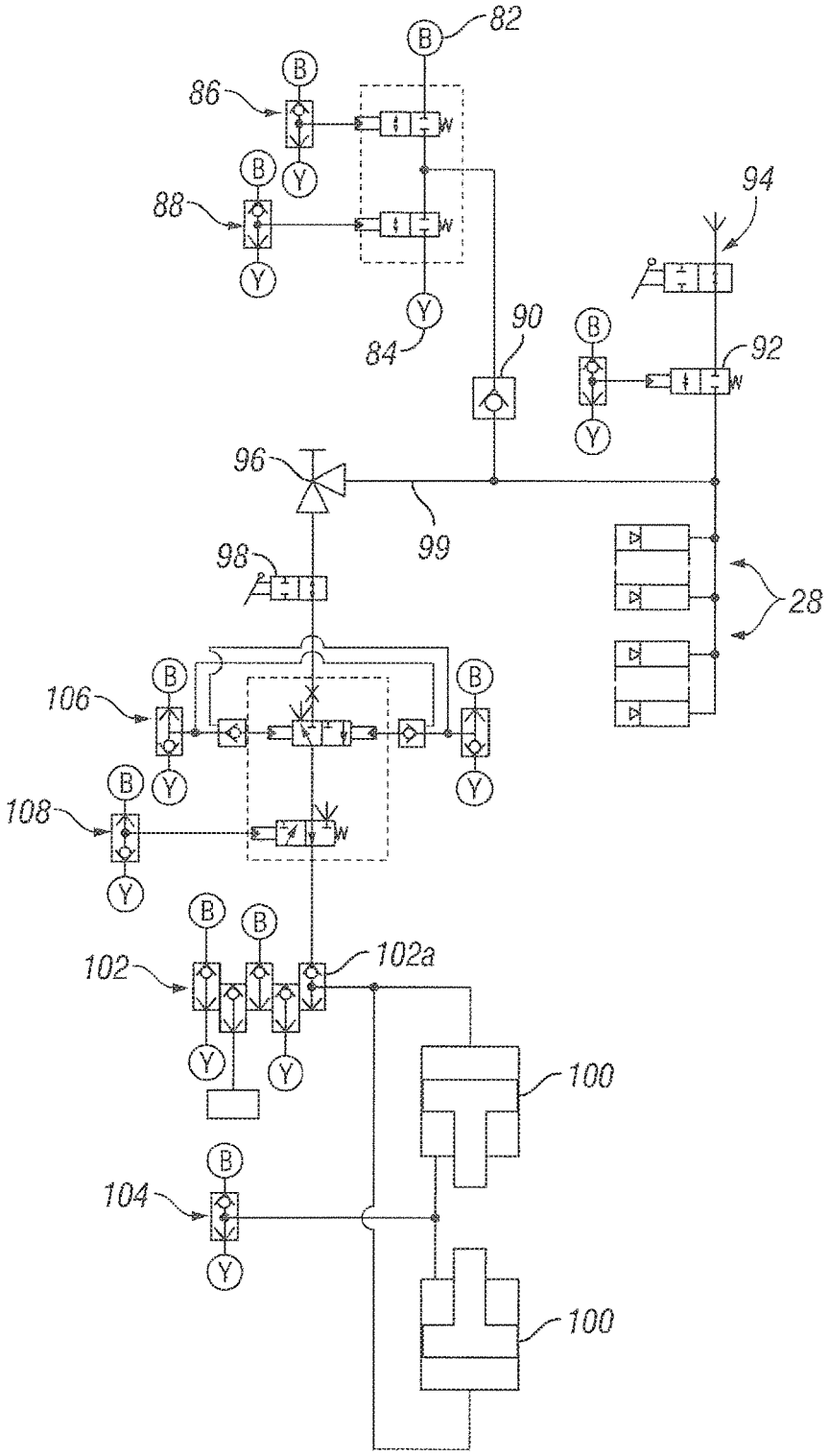
FIG. 5 is a hydraulic circuit diagram showing a BOP stack hydraulic circuit according to an alternate embodiment of the present technology.

With reference to FIG. 5, there is shown an alternate embodiment of the present technology, wherein a function of the BOP system is fired using the accumulators 28. The hydraulic circuit shown in FIG. 5 includes a blue pod hydraulic supply 82 and a yellow pod hydraulic supply 84 located upstream of the BOP functions. The blue pod hydraulic supply 82 communicates with functions of the BOP system via a blue pod isolation valve 86, and the yellow pod hydraulic supply 84 communicates with functions of the BOP system via a yellow pod isolation valve 88. A stack accumulator check valve 90 can be located in the conduit between the blue and yellow pod isolation valves 86, 88 and the functions of the BOP system, to prevent fluid flow from the accumulators from reaching the blue and yellow pod isolation valves 86, 88. One function of the blue and yellow hydraulic supplies 82, 84 in the embodiment of FIG. 5 is to help fill the accumulators 28.

Also located upstream of the BOP functions are the accumulators 28, as well as an accumulator dump valve 92 and an ROV accumulator dump valve 94. These dump valves 92, 94 are provided to vent pressure from the conduits leading from the accumulators 28 to the supply valve 96 in the event that the pressure in these conduits is too high. The dump valves 92, 94 can either bleed hydraulic fluid into the environment, or into a hydraulic fluid reservoir provided for such a purpose. Also located upstream of the BOP functions are the supply valve 96 and isolation valve 98. The supply valve 96 is described in greater detail below. The isolation valve 98 is capable of isolating all of the downstream BOP functions and components. In FIG. 4, the isolation valve 98 is shown located in the fluid conduit 99, downstream from the supply valve 96, but in practice the isolation valve 98 could alternately be positioned upstream of the supply valve 96.

Also shown in FIG. 5 are schematic representations of the ram pistons 100 with associated close valves 102 and opening valve 104. Each of the closing valves can be associated with a conduit carrying hydraulic fluid from a different source. For example, valve 102*a* is in fluid communication with the accumulators 28, valve 102*b*, 102*c*, 102*d* can be in fluid communication with the blue and yellow supplies 82, 84, and valve 102*e* can be configured for engagement with an ROV. In this way, multiple redundant hydraulic lines can be attached to the ram pistons 100 to ensure that the operator can close the ram pistons in the event of an emergency or other need to shut in the well by closing the BOP ram(s). FIG. 5 further depicts an autoshear arm/disarm valve 106 and trigger 108. Typically, the autoshear arm/disarm valve will always by armed, as long as there are shearable items (e.g., drill string, umbilicals, etc.) in the bore 21.

In the embodiment of the technology shown in FIG. 5, water hammer can be reduced by the supply valve 96, which is designed to have a reducing orifice that reduces flow through the supply valve 96 between the upstream side of the supply valve 96, nearer to the accumulators 28, and the downstream side of the supply valve 96, nearer to the BOP functions, such as the ram pistons 100. The particular shape of the orifice, and resultant reduction in flow through the supply valve 96, is dependent on the function, but is maintained so that the flow rate to the ram piston valve 102*a* is low enough to avoid water hammer in the piston valve 102*a*. In some embodiments, the supply valve 96 can be adjustable, by ROV or otherwise, so that the change in flow rate through the supply valve 96 can be tuned, or tailored to the particular downstream function to be fired, and other variables. In some alternate embodiments, the supply valve 96 could be automatically adjusted using automated controls.

While the present disclosure has been described with respect to a limited number of embodiments, those skilled in the art, having benefit of this disclosure, can appreciate that other embodiments may be devised which do not depart from the scope of the disclosure as described herein. Accordingly, the scope of the disclosure should be limited only by the attached claims.

What is claimed is:

1. A subsea blowout preventer (BOP) hydraulic control system to reduce water hammer, the system comprising:
- a first hydraulic fluid source;
- a first fluid supply conduit in fluid communication with the first hydraulic fluid source at an upstream end, and with a BOP function at a downstream end;
- a first supply valve in the first fluid supply conduit that controls the amount of fluid flow through the first fluid supply conduit to the BOP function, the first supply valve having an open state and a closed state, the first supply valve comprising:
  - a first choke that controls movement of the first supply valve between the open state and the closed state and vice versa so that such movement is retarded when the first supply valve state approaches the fully open or the fully closed state to reduce pressure spikes in the fluid of the first fluid supply conduit; and
- a dump valve that is remotely operable and that is positioned upstream from the first supply valve and downstream from an accumulator to vent fluid from the first fluid supply conduit.

2. The subsea BOP hydraulic control system of claim 1, wherein the first choke, absent opposing fluid forces, is biased toward the open state.

3. The subsea BOP hydraulic control system of claim 1, wherein the first choke, absent opposing fluid forces, is biased toward the closed state.

4. The subsea BOP hydraulic control system of claim 1, further comprising:
- a controller in communication with the first choke to instruct the first choke to open or close the first supply valve, as well the rate at which the first supply valve is opened or closed; and
- a sensor in communication with the BOP function and the controller to communicate to the controller the state of the BOP function as the BOP function fires.

5. The subsea BOP hydraulic control system of claim 1, wherein the BOP function is a pair of BOP rams.

6. The subsea BOP hydraulic control system of claim 1, further comprising:
- a second hydraulic fluid source;
- a second fluid supply conduit in fluid communication with the second hydraulic fluid source at an upstream end, and with a BOP function at a downstream end; and
- a second supply valve in the second fluid supply conduit that controls the amount of fluid flow through the second fluid supply conduit to the BOP function, the second supply valve having an open state and a closed state, the second supply valve comprising:
  - a second choke that controls movement of the second supply valve between the open state and the closed state and vice versa so that such movement is retarded when the second supply valve state approaches the fully open or the fully closed state to reduce pressure spikes in the fluid of the second fluid supply conduit.

7. The subsea BOP hydraulic control system of claim 6, wherein the second choke, absent opposing fluid forces, is biased toward the open state.

8. The subsea BOP hydraulic control system of claim 6, wherein the second choke, absent opposing fluid forces, is biased toward the closed state.

9. The subsea BOP hydraulic control system of claim 6, wherein:

the controller is in communication with the second choke to instruct the second choke to open or close the second supply valve, as well the rate at which the second supply valve is opened or closed; and the sensor in communication with the BOP function and the controller to communicate to the controller the state of the BOP function as the BOP function fires.

10. The subsea BOP hydraulic control system of claim 6, wherein the BOP function is a pair of BOP rams.

11. A subsea blowout preventer (BOP) hydraulic control system to reduce water hammer, the system comprising:

an accumulator;

a fluid supply conduit in fluid communication with the accumulator at an upstream end, and with a BOP function at a downstream end;

a supply valve in the fluid supply conduit that controls the amount of fluid flow through the fluid supply conduit to the BOP function, the supply valve having an open state and a closed state;

the supply valve comprising a choke to reduce the fluid flow rate in the fluid supply conduit downstream of the supply valve relative to the fluid flow rate in the fluid supply conduit upstream of the supply valve in order to reduce hydraulic shock; and a dump valve that is remotely operable and that is positioned upstream from the supply valve and downstream from the accumulator to vent fluid from the fluid supply conduit.

12. The subsea BOP of claim 11, wherein the supply valve is adjustable to increase or decrease the flow rate of fluid through the supply valve as desired by an operator.

13. The subsea BOP of claim 12, wherein the supply valve is adjustable by a remotely operated vehicle.

14. The subsea BOP of claim 11, wherein the BOP function is a pair of BOP rams.

15. The subsea BOP of claim 11, wherein the dump valve is a fail closed valve.

16. The subsea BOP of claim 15, wherein the dump valve is controlled using a remotely operated vehicle.

17. A method of firing a BOP function, the method comprising the steps of:

driving the BOP function using hydraulic fluid from a hydraulic fluid source, the hydraulic fluid delivered to the function via a fluid supply conduit between the hydraulic fluid source and the BOP function;

regulating the flow rate of the hydraulic fluid in the fluid supply conduit with a supply valve positioned in the fluid supply conduit between the hydraulic fluid source and the BOP function, the supply valve having a closed position, where fluid flow through the supply valve is restricted, and an open position, where some fluid passes through the supply valve;

providing a dump valve that is remotely operable and that is positioned upstream from the supply valve and downstream from an accumulator, the dump valve to vent the fluid supply conduit to initiate the BOP function, gradually opening the supply valve to gradually increase the rate of fluid flow through the supply valve up to a predetermined amount; and before termination of the BOP function, gradually closing the supply valve to gradually decrease the rate of fluid flow through the supply valve until the BOP function is complete.

18. The method of claim 17, wherein the BOP function is the closing of a pair of BOP rams.

19. The method of claim 18, further comprising:

sensing the position of the BOP rams as they close; and communicating data about the position of the BOP rams to a controller.

20. The method of claim 19, further comprising:

controlling the rate of opening and closing the supply valve based on the data about the position of the BOP rams and corresponding instructions transmitted from the controller to the supply valve.

* * * * *